US005261919A

United States Patent [19]

Niedertscheider

[11] Patent Number: 5,261,919

[45] Date of Patent: Nov. 16, 1993

[54] DEPILATION APPARATUS

[75] Inventor: Reinhard Niedertscheider, Klagenfurt, Austria

[73] Assignee: U.S. Philips Corporation, New York, N.Y.

[21] Appl. No.: 942,119

[22] Filed: Sep. 8, 1992

Related U.S. Application Data

[63] Continuation of Ser. No. 758,054, Sep. 12, 1991.

[30] Foreign Application Priority Data

Sep. 19, 1990 [AT] Austria ..... 1901/90

[51] Int. Cl.[5] ..... A45D 26/00

[52] U.S. Cl. ..... 606/133; 606/131

[58] Field of Search ..... 606/131, 133; 452/83

[56] References Cited

U.S. PATENT DOCUMENTS 5,041,122 8/1991 Schneider et al. ..... 606/133

5,071,423 12/1991 Piber et al. ..... 606/133

5,084,056 1/1992 Eckel et al. ..... 606/133

FOREIGN PATENT DOCUMENTS 2307491 4/1975 France ..... 606/133

2454283 12/1980 France ..... 606/133

0652899 12/1985 Switzerland ..... 606/133

*Primary Examiner*—Stephen C. Pellegrino

*Assistant Examiner*—Glenn Dawson

*Attorney, Agent, or Firm*—Ernestine C. Bartlett

[57] ABSTRACT

In a depilation apparatus (1) having at least two depilation rollers (26, 27, 28, 29, 30, 31) which form at least one roller pair (23, 24, 25), and having a skin-protection device (16) for each roller pair (23, 24, 25) having only one rod-like skin-protection member (38, 39, 40) which is situated within the cross-sectionally conical area (50, 51, 52) between the two depilation rollers (26, 27, 28, 29, 30, 31) of the relevant roller pair (23, 24, 25).

6 Claims, 2 Drawing Sheets

DEPILATION APPARATUS

This is a continuation of application Ser. No. 07/758,054, filed Sep. 12, 1991.

FIELD OF THE INVENTION

The invention relates to a depilation apparatus for the extraction of hairs from the skin, which apparatus comprises at least two depilation rollers which form at least one roller pair and which are rotatably supported and rotatably drivable, the two depilation rollers of a roller pair cooperating circumferentially with one another with a part of each roller and performing a rotary movement during depilation, during which the circumferentially cooperating parts of said two depilation rollers move away from the skin, and a skin-protection device which is associated with the depilation rollers and is situated at the side of the depilation rollers which faces the skin during depilation, which device allows hairs to enter the area where the two depilation rollers of each roller pair cooperate circumferentially, but keeps the skin away from the area where the two depilation rollers of each roller pair cooperate circumferentially.

BACKGROUND OF THE INVENTION

A depilation apparatus of the type as defined in the opening paragraph is known, for example from French Patent Specification 2,307,491. In this known depilation apparatus the depilation rollers are circularly cylindrical and the skin-protection device is constituted by a shear plate which covers the depilation rollers and which is disposed in a plane which is spaced from the depilation rollers and which extends parallel to a common plane which is tangent to the depilation rollers thus covered. The shear plate has elongate hair-entry apertures situated opposite the depilation rollers and extending adjacent one another and obliquely relative to the longitudinal direction of the depilation rollers. It has been found that such a shear plate keeps the skin effectively away from the depilation rollers but to a comparatively large extent also hinders the access of hairs to the area where the two depilation rollers of each roller pair cooperate circumferentially, which impairs or hinders the depilation process so that depilation requires a comparatively long time. It has also been found that such a shear plate only allows the access of comparatively long hairs to the area where the two depilation rollers of each roller pair cooperate circumferentially but inhibits the access of comparatively short hairs to this area of circumferential cooperation, so that the known depilation apparatus allows only comparatively long hairs to be extracted for which, as stated above, a comparatively long time is needed.

SUMMARY OF THE INVENTION

An object of the invention is to mitigate the above problems and to ensure both an effective skin protection and an effective entry of hairs to the area where the two depilation rollers of each roller pair cooperate circumferentially in a depilation apparatus of the type defined in the opening paragraph. Moreover, this effective hair entry should not be limited to comparatively long hairs but should also be guaranteed for comparatively short hairs. To this end the invention is characterized in that for each roller pair the skin-protection device comprises a single rod-like skin-protection member whose longitudinal axis extends substantially parallel to a line of intersection of two enveloping surfaces which are equispaced from the two depilation rollers of the relevant roller pair. This line is parallel to a plane which is tangent to both depilation rollers of the depilation pair and is situated substantially within the cross-sectionally conical area between the two depilation rollers of the relevant roller pair, which conical area is bounded by a plane which is tangent to both depilation rollers of the relevant roller pair. This ensures an effective skin protection, because the skin cannot reach the area where the depilation rollers cooperate circumferentially. At the same time this also ensures an effective access of hairs to the area where the two depilation rollers of each roller pair cooperate circumferentially because the depilation rollers are wholly free for the greater part and thus promote the supply of hairs to the area where the depilation rollers cooperate, which is favorable for a rapid depilation.

The effective entry of hairs is guaranteed both for comparatively long hairs and for comparatively short hairs and is not restricted to comparatively long hairs. Because the skin-protection member which forms the skin-protection device can be arranged very close to the area where the depilation rollers cooperate, short hairs can also reach this area.

The depilation rollers may be circularly cylindrical or frustoconical, and in the latter case this enables different circumferential speeds to be obtained along the depilation rollers of each roller pair, which results in different depilatory actions along the depilation rollers of each roller pair.

The depilation rollers may be circumferentially smooth or they may be toothed, the teeth and tooth gaps which extend in the longitudinal direction of the depilation rollers successively coming into mesh with one another to extract hairs from the skin.

The cross-sectional shape of each skin-protection member may be circular. Consequently, each skin-protection member may be constituted by a circularly cylindrical rod. It is preferred that in cross-section each skin-protection member substantially has the shape of an isosceles triangle, the base of the triangle extending substantially parallel to the plane which is tangent to the two depilation rollers of the relevant roller pair, between which the skin-protection member is situated. Such a skin-protection member can readily be adapted to the cross-sectionally conical area between the two depilation rollers of the relevant roller pair.

With respect to the construction of each skin-protection member, in another preferred embodiment in cross-section each skin-protection member substantially has the shape of a rectangle, two sides of the rectangle extending substantially parallel to the plane which is tangent to the two depilation rollers of the relevant roller pair, between which the skin-protection member is situated. Such a skin-protection member has the advantage that it can be manufactured very simply.

In a depilation apparatus in accordance with the invention comprising more than one roller pair it is preferred that at at least one of the ends of the skin-protection members of the skin-protection device, which are each associated with one roller pair, are connected to form a single part by means of a connecting member which extends transversely of the skin-protection members. This has the advantage that the skin-protection members can be mounted simply on the depilation apparatus.

It is then especially preferred that if at both ends the skin-protection members of the skin-protection device, which are each associated with one roller pair, are connected to form a single part by means of a connecting member which extends transversely of the skin-protection members. This results in a comparatively high resistance to inadvertent bending or flexure of the skin-protection members.

It is then also especially preferred that at both ends the two connecting members of the skin-protection device are interconnected by further connecting members which extend parallel to the skin-protection members, the two connecting members and the two further connecting members forming a frame. Such a skin-protection device has the advantage of a comparatively high mechanical stability.

In such depilation apparatus in accordance with the invention which comprise more than one roller pair it is preferred that the single part formed by the skin-protection members and at least one connecting member is connected to the depilation apparatus by means of its at least one connecting member. This is advantageous in order to simplify mounting of the skin-protection members on the depilation apparatus.

BRIEF DESCRIPTION OF THE DRAWING

Embodiments of the invention will now be described in more detail, by way of non-limitative example, with reference to the accompanying drawings.

In the drawings,

FIG. 4 also shows a part of the depilation apparatus in a plan view taken on the line IV—IV in FIG. 3;

DETAILED DESCRIPTION OF PREFERRED EMBODIMENTS

Figure 1:
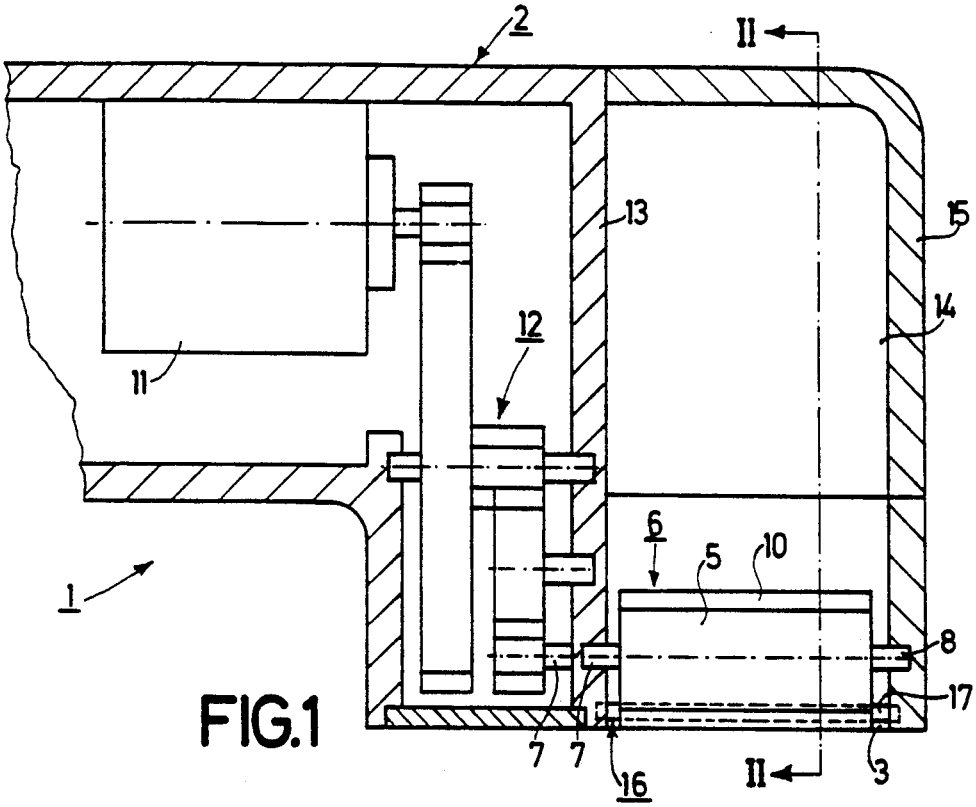
FIG. 1 is a longitudinal sectional view showing a part of a depilation apparatus with two circumferentially toothed depilation rollers, which are rotatably supported at both ends, and with a rod-shaped skin-protection member of triangular cross-section.
Figure 2:
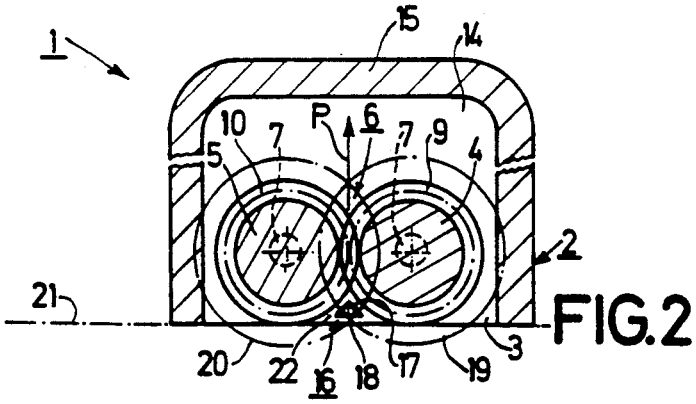
FIG. 2 shows a part of the depilation apparatus with two circumferentially toothed depilation rollers and a rod-shaped skin-protection member of triangular cross-section in a sectional view taken on the line II—II in FIG. 1.

FIGS. 1 and 2 both show a part of a depilation apparatus 1 for extracting hairs from the skin. The depilation apparatus 1 comprises a multi-part housing 2 which can be hand-held. The housing 2 has an opening 3 at which two depilation rollers 4 and 5 are arranged, which form a roller pair 6. The two depilation rollers 4 and 5 are each rotatably supported at both ends by means of two journals 7 and 8, the two journals engaging in associated bores in the housing 2. The circumferential surfaces of the depilation rollers 4 and 5 have involute teeth 9 and 10 respectively, shown only diagrammatically in FIGS. 1 and 2. The teeth 9 and 10 and the tooth gaps between them extend in the axial directions of the two depilation rollers 4 and 5. Of the two depilation rollers 4 and 5 one depilation roller 4 is rotatably drivable by means of a motor 11 in the depilation apparatus 1 via a multi-stage gear mechanism 12 and the journal 7, which for this purpose is passed through a wall 13 of the housing 2. When the one depilation roller 4 is driven by the motor the other depilation roller 5 is also rotated via the intermeshing teeth 9 and 10. The two depilation rollers 4 and 5 of the roller pair 6 always cooperate with each other with circumferential parts, i.e. with their tooth flanks. The motor 11 drives the depilation rollers 4 and 5 of the roller pair 6 in such a way that during depilation they perform a rotation for which the circumferentially cooperating parts, i.e. the tooth flanks of these two depilation rollers 4 and 5 move away from the skin, as is indicated by an arrow P in FIG. 2. Thus, at the location where they cooperate circumferentially the depilation rollers 4 and 5 are capable of gripping a hair which is caught between them and of exerting a pulling force on this hair to extract it from the skin. Subsequently, the depilation rollers 4 and 5 feed a hair thus extracted from the skin into an adjoining collecting chamber 14 of the depilation apparatus 1. This collecting chamber 14 can be closed by means of a cover 15 which is detachable from the housing 2 for cleaning purposes.

It is found to be very effective to provide a depilation apparatus 1 of this type with a skin-protection device 16 associated with one of the depilation rollers 4 and 5, which device is situated at the side of the depilation rollers 4 and 5 which faces the skin during depilation and which allows hairs to enter the location where the two depilation rollers 4 and 5 of the roller pair 6 cooperate circumferentially but which keeps the skin away from the location where the two depilation rollers 4 and 5 of the roller pair 6 cooperate circumferentially. Such a skin-protection device 16 should provide an effective skin protection, i.e. it should ensure that the skin is kept away from the area of circumferential cooperation of the depilation rollers, and should also guarantee an effective entry of hairs to the area where the depilation rollers cooperate circumferentially, said effective entry being obtained not only for comparatively long hairs but also for comparatively short hairs. In order to meet these requirements it is preferred that the skin-protection device 16 for the roller pair 6 only comprises a rod-like skin-protection member 17 whose longitudinal axis extends substantially parallel to a line 18 of intersection of two, in the present case cylindrical, enveloping surfaces 19 and 20 which are equispaced from the two depilation rollers 4 and 5, which line is situated substantially within the cross-sectionally conical area 22 between the two depilation rollers 4 and 5 of the roller pair 6, which which is bounded by a plane 21 which is tangent to both depilation rollers 4 and 5 of the roller pair 6. The cylindrical enveloping surfaces 19 and 20 and the tangential plane 21 are shown in dash-dot lines in FIG. 2. In the present case the entire skin-protection device 16 comprises only this one rod-shaped skin-protection member 17. Such a skin-protection member 17 simply fulfils the conflicting and therefore difficult to meet requirements of guaranteeing an effective skin protection and an effective access of hairs to the depilation rollers. A satisfactory access is then obtained both for long hairs and short hairs because the skin-protection member can be arranged near the area where the depilation rollers cooperate circumferentially, so that comparatively short hairs can also come between the tooth flanks of the depilation rollers 4 and 5. Since the depilation rollers 4 and 5 are completely free adjacent the skin-protection member 17, they assist in feeding hairs to the area of circumferential cooperation between the depilation roller 4 and 5, which promotes a rapid depilation.

In the depilation apparatus 1 shown in FIGS. 1 and 2 the rod-shaped skin-protection member 17 has the cross-sectional shape of an isosceles triangle, the base of the triangle extending substantially parallel to the plane 21 which is tangent to the two depilation rollers 4 and 5 of the roller pair 6, between which the skin-protection member 17 is situated. A skin-protection member 17 of this construction can readily be adapted to the cross-sectionally conical area 22 between the two depilation rollers 4 and 5 of the roller pair 6, so that the skin-protection member 17 can be arranged very close to the area where the tooth flanks of the depilation rollers 4 and 5 cooperate with each other to extract hairs. The skin-protection member 17 is secured by fitting each of the ends of this member in a recess of suitable cross-section in the housing 2 of the depilation apparatus 1. The skin-protection member 17 is, for example, made of steel.

Figure 3:
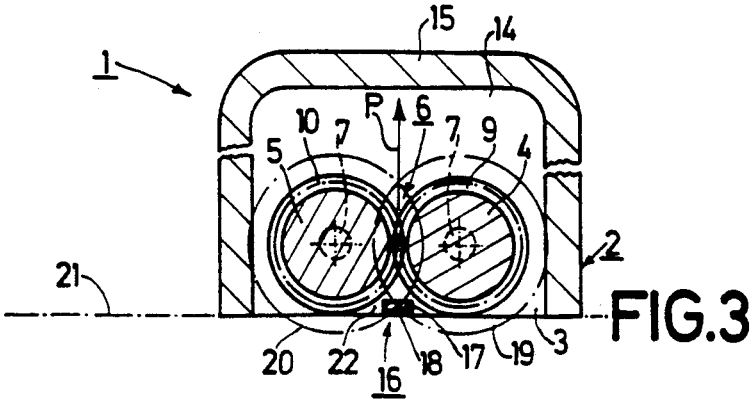
FIG. 3, in the same way as FIG. 2, shows a part of another depilation apparatus with two circumferentially toothed depilation rollers and with a rod-shaped skin protection member of rectangular cross-section.

In another depilation apparatus 1 as shown in FIG. 3 the skin-protection member 17 which forms the entire skin-protection device 16 has a rectangular cross-sectional shape, two sides of the rectangle extending parallel to the plane 21 which is tangent to both depilation rollers 4 and 5 of the roller pair 6, between which the skin-protection member 17 is situated. Such a skin-protection member 17 also guarantees both an effective skin protection and a satisfactory access of hairs to the area where the depilation roller 4 and 5 of the roller pair cooperate circumferentially. Such a skin-protection member can be manufactured very simply.

Figure 4:
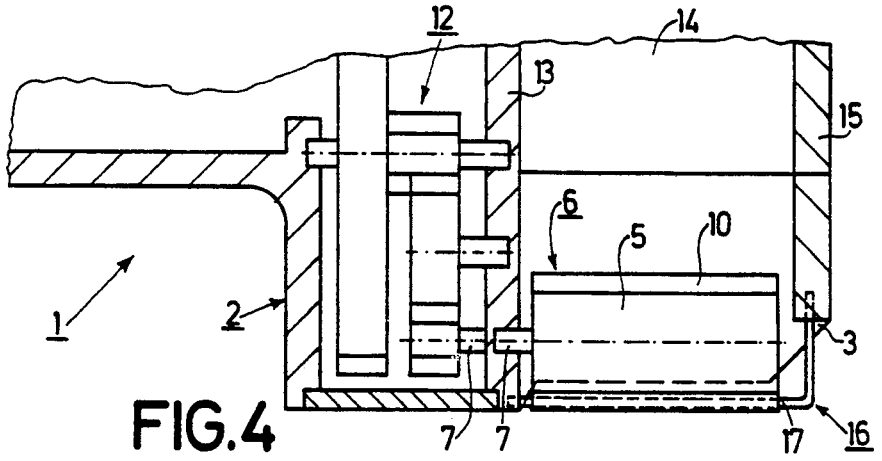
FIG. 4, in the same way as FIG. 1, shows a part of a second embodiment of a depilation apparatus with two circumferentially toothed depilation rollers which are rotatably supported at one end and with a rod-shaped skin protection member of circular cross-section.

In a further embodiments of a depilation apparatus 1 as shown in FIG. 4 the two depilation rollers 4 and 5 are rotatably supported at one end only, i.e. by means of only one journal 7 which engages a bore in the housing 2. The skin protection device 16 of the depilation apparatus 1 shown in FIG. 4 is a single rod-shaped cross-sectionally circular, i.e. circularly cylindrical, skin-protection member 17. The circularly cylindrical rod-shaped skin-protection member 17 is right-angled at the location of each end of the two depilation rollers 4 and 5, which do not comprise journals. In this case the two ends of the rod-shaped skin-protection member 17 also engage recesses provided for this purpose in the housing 2 of the depilation apparatus 1. In addition to an effective skin protection this depilation apparatus also provides a very effective access of hairs to the area where the depilation rollers 4 and 5 cooperate circumferentially, because entry is also possible from the freely projecting ends of the depilation rollers 4 and 5, which do not comprise journals.

Figure 5:
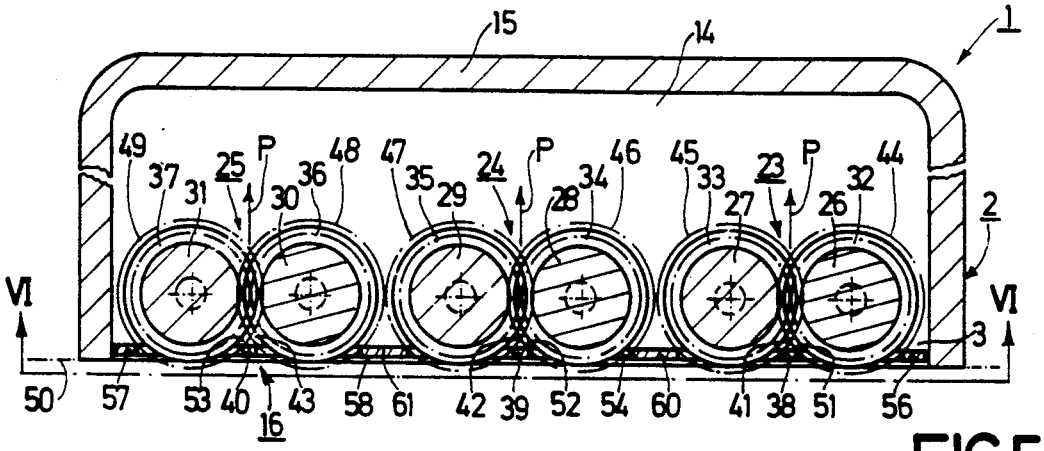
FIG. 5, in the same way as FIGS. 2 and 3, shows a part of a further depilation apparatus with six circumferentially toothed depilation rollers which are rotatably supported at both ends and which form three roller pairs, a rod-shaped skin protection member of rectangular cross-section being associated with each roller pair.
Figure 6:
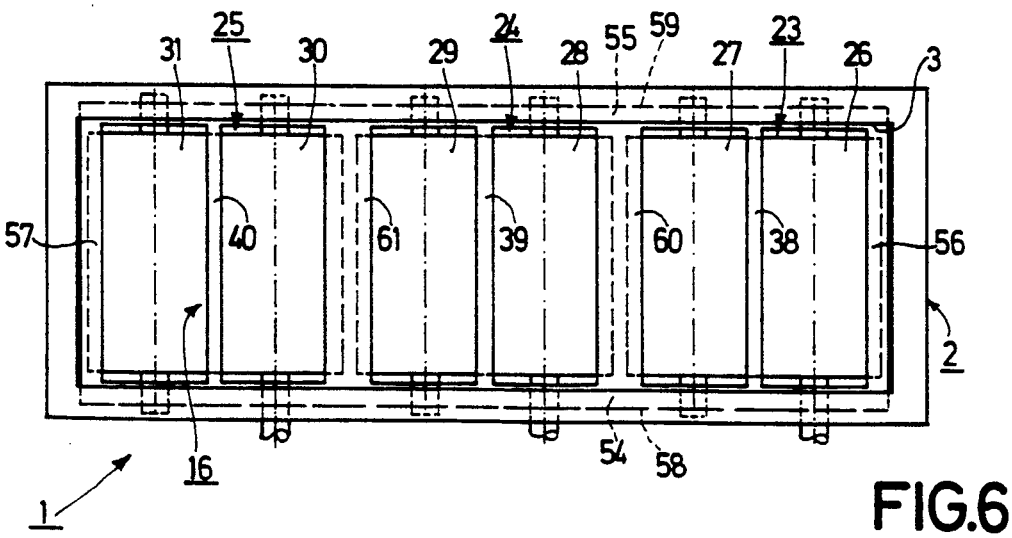
FIG. 6 shows the part of the depilation apparatus of FIG. 5 in a view taken on the line VI—VI in FIG. 5.

A further depilation apparatus 1 as shown in FIGS. 5 and 6 comprises more than one roller pair, i.e. in total three roller pairs 23, 24 and 25. Each of these roller pairs 23, 24 and 25 comprises two depilation rollers 26 and 27, 28 and 29, and 30 and 31 respectively. The depilation rollers 26, 27, 28, 29, 30 and 31 of this depilation apparatus 1 also have involute teeth 32, 33, 34, 35, 36 and 37 respectively, but may alternatively have smooth cylindrical, for example rubber, surfaces. The depilation rollers 26, 28 and 30 can be driven, in a manner not shown, by a motor of the depilation apparatus 1. The other depilation rollers 27, 29 and 31 can be driven by the depilation rollers 26, 28 and 30 via the intermeshing teeth 32, 33, 34 and 35, 36, 37 respectively. During depilation the depilation rollers perform such a rotation that their circumferentially cooperating portions, i.e. the tooth flanks of their teeth, move away from the skin, as is indicated by the arrows P in FIG. 5.

The depilation apparatus shown in FIGS. 5 and 6 also comprises a skin-protection device 16. For each roller pair 23, 24 and 25 the skin-protection device 16 now has a rod-like skin-protection member 38, 39 and 40 respectively, whose longitudinal axis extends substantially parallel to a line 41, 42 or 43 of intersection of two, in the present case cylindrical, enveloping surfaces 44, 45; 46, 47, and 48, 49 respectively which are equispaced from the two depilation rollers 26, 27; 28, 29 and 30, 31 of the relevant roller pair 23, 24 and 25 respectively, which line is situated within the cross-sectionally conical area 51, 52 or 53 between the two depilation rollers 26, 27; 28, 29 and 30, 31 respectively of the relevant roller pair 23, 24 and 25, which area is bounded by a plane 50 which is tangent to both depilation rollers 26, 27; 29, 29 and 30, 31 of the relevant roller pair 23, 24 and 25 respectively. The skin-protection members 38, 39 and 40 have a rectangular cross-sectional shape, two sides of the rectangle extending parallel to the plane 50 tangent to the two depilation rollers 26, 27; 28, 29 and 30, 31 of the relevant roller pair 23, 24 and 25 respectively, between which the respective skin-protection member 38, 39 or 40 is situated. The tangential plane 50 is shown as a dash-dot line in FIG. 5.

Connecting members 54 and 55, which extend transversely of the skin-protection members 38, 39 and 40, interconnect the skin-protection members 38, 39 and 40 of the skin-protection device 16 at both ends to form a single part. At both ends the two connecting members 54 and 55 of the skin-protection device 16 are interconnected by further connecting members 56 and 57 respectively which extend parallel to the skin-protection members 38, 39 and 40. The two connecting members 54 and 55 and the two further connecting members 56 and 57 thus constitute a frame. The part formed by the skin-protection members 38, 39, 40 and the connecting members 54, 55, 56, 57 is connected to the depilation apparatus 1 by its two connecting members 54 and 55. For this purpose the two connecting members 54 and 55 each engage a slot-like recess 58 or 59 in the housing 2. This results in a stable construction and simple mounting of the skin-protection device which is made up of a plurality of skin-protection members. In addition, the part described above comprises two further members 60 and 61 situated in the area between the two depilation rollers 27 and 28 of the roller pairs 23 and 24 and the area between the two depilation rollers 29 and 30 of the roller pairs 24 and 25. These members 60 and 61 have the advantage that they prevent hairs fed into the collecting chamber 14 and collected therein from falling out of this collecting chamber.

I claim:

1. A depilation apparatus for the extraction of hairs from the skin, which apparatus comprises a housing with at least two depilation rollers and means for rotatably driving said rollers, which rollers form at least one roller pair and which are rotatably supported and rotatably drivable, each depilation roller of said roller pair cooperating circumferentially with a part of the other roller of said roller pair and performing a rotary movement during depilation, during which the circumferentially cooperating parts of said two depilation rollers move away from the skin, and a skin-protection device which is connected to the housing and at a side of the depilation rollers which faces the skin during depilation, said skin protecting device allowing hairs to enter an area where the two depilation rollers of each roller pair cooperate circumferentially, but keeps the skin away from the area where the two depilation rollers of each roller pair cooperate circumferentially, wherein for each roller pair the skin-protection device comprises a single rod-like skin-protection member the longitudinal axis of which extends substantially parallel to a plane which is tangent to both depilation rollers of the roller pair and lies within a cross-sectional conical area between the two rollers of the roller pair, which area is bounded by said tangent plane.

2. A depilation apparatus as claimed in claim 1, wherein in cross-section each skin-protection member substantially has the shape of an isosceles triangle, the base of the triangle being substantially parallel to the surface of the skin to be depilated, and also extending substantially parallel to the plane which is tangent to the two depilation rollers of the roller pair, between which the skin-protection member is situated.

3. A depilation apparatus as claimed in claim 1, wherein in cross-section each skin-protection member substantially has the shape of a rectangle, two sides of the rectangle being substantially parallel to the surface of the skin to be depilated, and extending substantially parallel to the plane which is tangent to the two depilation rollers of the roller pair, between which the skin-protection member is situated.

4. A depilation apparatus as claimed in claim 1 wherein the skin-protection device further comprises at least one connecting member connected to the housing; a plurality of roller pairs, wherein at least one end of each respective skin-protection member of the skin-protection device is connected to an end of another skin protection member by means of the connecting member which extends transversely of the skin-protection members.

5. A depilation apparatus as claimed in claim 4 comprising a second connecting member wherein the other end of each respective skin-protection member of the skin protection device is connected to an end of another skin-protection member by means of said second connecting member which extends transversely of the skin-protection members.

6. A depilation apparatus as claimed in claim 5, wherein both ends of each of the two connecting members of the skin-protection device are interconnected by further connecting members which extend parallel to the skin-protection members, the two connecting members and the two further connecting members forming a frame.

* * * * *